US012590776B2

(12) United States Patent
Hoffman et al.

(10) Patent No.: US 12,590,776 B2
(45) Date of Patent: Mar. 31, 2026

(54) DISCREET BLANK FIRING ADAPTER

(71) Applicant: The United States of America, as Represented by the Secretary of the Navy, Crane, IN (US)

(72) Inventors: Brian R Hoffman, Bloomington, IN (US); Caleb W. McGee, Bloomington, IN (US)

( * ) Notice: Subject to any disclaimer, the term of this patent is extended or adjusted under 35 U.S.C. 154(b) by 0 days.

(21) Appl. No.: 18/754,439

(22) Filed: Jun. 26, 2024

(65) Prior Publication Data

US 2025/0060184 A1 Feb. 20, 2025

Related U.S. Application Data

(60) Provisional application No. 63/523,760, filed on Jun. 28, 2023.

(51) Int. Cl.
*F41A 21/32* (2006.01)
*F41A 21/26* (2006.01)
*F41A 33/00* (2006.01)

(52) U.S. Cl.
CPC ..... *F41A 33/00* (2013.01); *F41A 21/26* (2013.01); *F41A 21/32* (2013.01)

(58) Field of Classification Search
CPC ..... F41A 21/26; F41A 21/32; F41A 33/00
See application file for complete search history.

(56) References Cited

U.S. PATENT DOCUMENTS 3,363,509 A * 1/1968 Tschoepe ..... F41A 21/26 89/14.5
3,941,029 A * 3/1976 Skahill ..... F41A 21/26 89/14.5
5,140,893 A * 8/1992 Leiter ..... F41A 21/26 89/14.5
2006/0243125 A1* 11/2006 La France ..... F41A 21/26 89/31

FOREIGN PATENT DOCUMENTS

GB 2163840 A * 3/1986 ..... F41A 21/26

* cited by examiner

*Primary Examiner* — Jonathan C Weber
(74) *Attorney, Agent, or Firm* — Christopher Feigenbutz; Naval Surface Warfare Center, Crane Division

(57) ABSTRACT

Provided is a blank firing adapter for a firearm that prevents a bullet or fragmentation from exiting a firearm barrel and traveling downrange. The device includes a body, a fore end, an aft end, a bore, a transverse exhaust hole, and a flange. The body is positioned within a muzzle end of the firearm barrel. The fore end includes a solid material to prevent bullet fragmentation from directly exiting the barrel in a direction coinciding with a point-of-aim direction when a live round is fired, and the transverse exhaust hole redirects gas traveling through the bore to a direction transverse to the muzzle end of the barrel. The device generates backpressure to permit automatic cycling of a weapon system, safely catches a fired bullet without any fragmentation to travel downrange, and is visually inconspicuous to the casual observer when installed, while allowing for the use of externally attached devices.

27 Claims, 11 Drawing Sheets

DISCREET BLANK FIRING ADAPTER

CROSS-REFERENCE TO RELATED APPLICATIONS

The present application claims priority to U.S. Provisional Patent Application Ser. No. 63/523,760, filed Jun. 28, 2023, entitled "ISCREET BLANK FIRING ADAPTER," and U.S. Provisional Patent Application Ser. No. 63/627,848, filed Feb. 1, 2024, entitled "DISCREET BLANK FIRING ADAPTER," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 211643US03) is assigned to the United States Government and is available for licensing for commercial purposes. Licensing and technical inquiries may be directed to the Technology Transfer Office, Naval Surface Warfare Center Crane, email: Crane_T2@navy.mil.

FIELD OF THE INVENTION

The field of invention relates generally to safety mechanisms for preventing firearms from firing live ammunition. More particularly, it pertains to a discrete blank firing adapter for a firearm that prevents a bullet or any bullet fragmentation from a fired live round from exiting a firearm barrel and traveling downrange.

BACKGROUND

During force on force training exercises, negligent discharges of live rounds are periodically encountered that can lead to injury or death. It is also possible that someone would intentionally attempt to load and fire live rounds during a training scenario with the intent to do harm. There is a need for a blank firing only training system that increases safety by successfully addressing the scenario of a negligent or intentional discharge of a standard combat cartridge in the training.

Prior methods of discouraging the firing of standard combat ammunition in training weapons include cartridge feeding discriminators (such as modified magazines or feed trays), custom barrels with unique chambers and unique blank training ammunition, physical impediments in the barrel to prevent chambering of standard combat cartridges (such as U.S. Pat. Nos. 8,683,728 and 9,188,402), and various gas venting methods (such as U.S. Pat. No. 5,740,626) that attempt to slow down or prevent the bullet from a standard combat cartridge from exiting the barrel. With exception to a custom barrel and unique cartridge chamber with unique blank ammunition (of a non-standard configuration), the other proposed solutions are not completely reliable. Even the solutions that suggest a physical impediment just forward of the cartridge chamber (to interfere with the bullet of an incoming standard combat cartridge) do not always reliably induce the desired effect and will sometimes allow for the bullet to be farther seated within the cartridge case during chambering and still be fired.

Methods such as gas venting are also problematic in that these solutions allow for the possibility of bullet stack-up to occur within the barrel, which can lead to dramatic overpressure situations and catastrophic failure. This can lead to safety risks for both the operator and those who may be in close proximity. While solutions relying on custom barrels with unique cartridge chambers and unique ammunition can prevent the chambering of standard combat ammunition, these solutions are costly and inherently demand dependence on unique and often proprietary, non-standard blank cartridges. This drives up lifecycle costs and introduces unwanted logistics and acquisition challenges in order to fund and maintain the required barrel and ammunition inventories.

Other methods currently employed include the use of external blank fire adapters (BFAs). For most current military applications, the BFA is attached externally, with respect to the barrel bore, in a manner allowing for intentional visibility. Often times, the BFA is attached to the barrel in one of two ways. Either it attaches to an existing muzzle device, such as a flash hider, or it replaces that existing muzzle device and attaches directly to the external muzzle threads that are there. The former method is popular for systems that do not employ dedicated blank fire barrels because the BFA can be selectively attached and used as needed to support training activities with blank ammunition. The latter method is more popular for applications using dedicated blank fire barrels as it allows for a simpler and more cost-effective BFA design. The latter approach is also often used for applications desiring to permanently secure the BFA to the barrel via example methods such as welding or pinning, either with or without a threaded connection.

In both prior art designs as described above, these devices require the BFA to be attached externally, which may be undesirable in instance where authenticity is sought, or where an external device is to be attached to the firearm (such as a suppressor). As can be seen from the above, there is a need for a blank firing adapter that prevents a bullet or any bullet fragmentation from a fired live round from exiting a firearm barrel and traveling downrange, is not externally visible, and allows for attachment of external devices to the barrel.

SUMMARY OF THE INVENTION

The present invention relates to a blank firing adapter (BFA) for a firearm that is capable of generating sufficient backpressure to permit automatic cycling of a weapon system, prevents a bullet or any bullet fragmentation from a fired live round from exiting a firearm barrel and traveling downrange, is visually inconspicuous to the casual observer when installed, and allows for the use of externally attached devices. The device includes a body, a fore end, an aft end, a bore, a transverse exhaust hole, and a flange. The body is positioned within a muzzle end of the firearm barrel and the flange is positioned exterior to and abutting the muzzle end of the firearm barrel. The bore extends from the aft end through the body and terminates at the transverse exhaust hole. The transverse exhaust hole includes an aperture that redirects gas traveling through the bore to a direction transverse to the muzzle end of the barrel. The fore end includes a solid material to prevent bullet fragmentation from directly exiting the barrel in a direction coinciding with a point-of-aim direction when a live round is fired. The inventive BFA offers a cost-effective and robust solution that generates sufficient backpressure to permit reliable automatic cycling in weapon applications capable of automatic cycling, safely catches the bullet of a fired live round without allowing the bullet or any bullet fragmentation to travel downrange, and performs these functions in a way where the BFA itself is visually inconspicuous to the casual observer when installed while allowing for the use of externally attached devices.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Generally, provided is a blank firing adapter (BFA) for a firearm barrel comprising a body, a fore end, an aft end, a bore, a transverse exhaust hole, and a flange. In an illustrative embodiment, the body is positioned within a muzzle end of the firearm barrel and the flange is positioned exterior to and abutting the muzzle end of the firearm barrel. In an illustrative embodiment, the bore extends from the aft end through the body and terminates at the transverse exhaust hole. In an illustrative embodiment, the transverse exhaust hole comprises an aperture that redirects gas traveling through the bore to a direction transverse to the muzzle end of the barrel. In an illustrative embodiment, the fore end comprises a solid material to prevent bullet fragmentation from directly exiting the barrel in a direction coinciding with a point-of-aim direction when a live round is fired.

Figure 1:
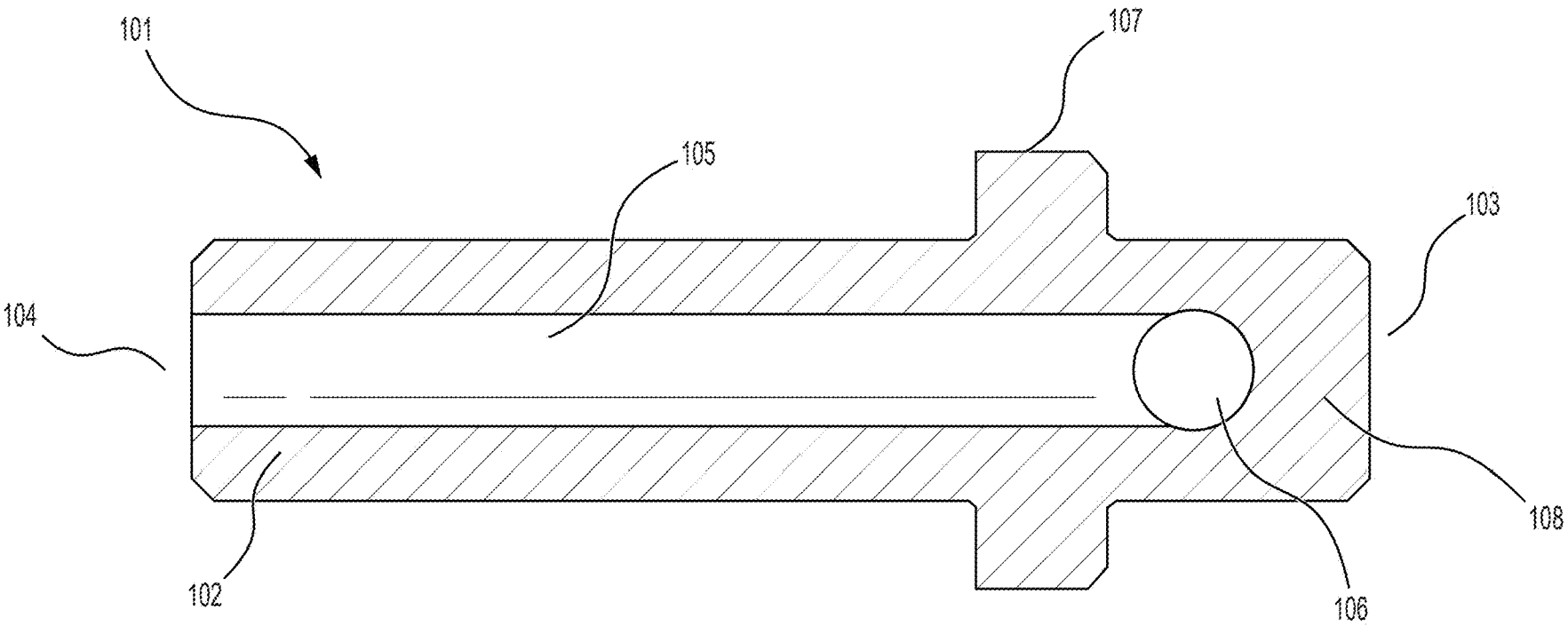
FIG. 1 shows a side sectional view of a blank firing adapter.
Figure 2:
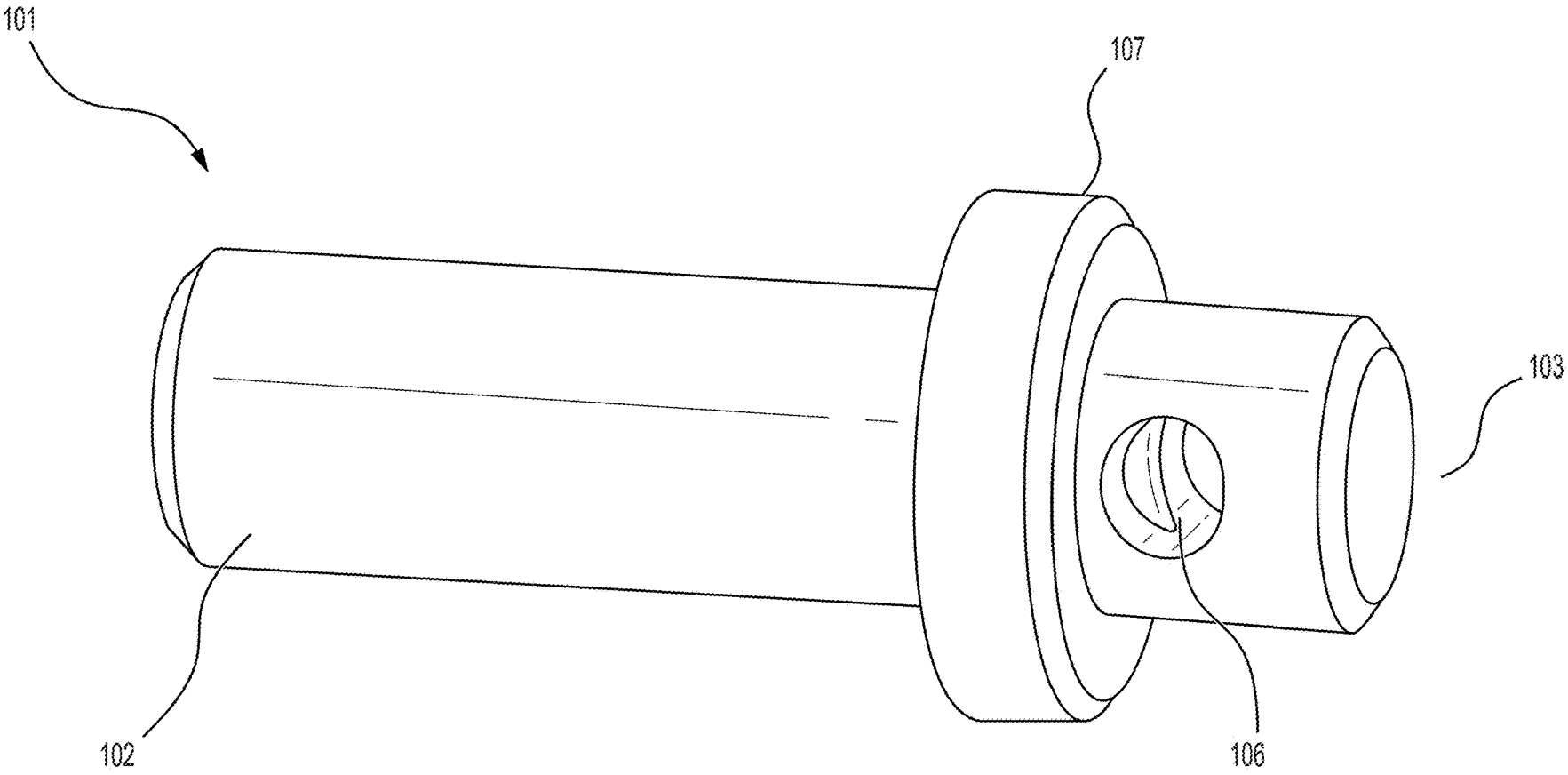
FIG. 2 shows a perspective view of a blank firing adapter.

FIG. 1 shows a side sectional view of a discrete blank firing adapter 101, and FIG. 2 shows a perspective view of a blank firing adapter 101. In an illustrative embodiment, the device comprises a body 102, a fore end 103, an aft end 104, a bore 105, a transverse exhaust hole 106, and a flange 107. In an illustrative embodiment, the body 102 is positioned within a muzzle end of the firearm barrel (shown below) and the flange 107 is positioned exterior to and abutting the muzzle end of the firearm barrel. In an illustrative embodiment, the bore 105 extends from the aft end 104 through the body 102 and terminates at the transverse exhaust hole 106. In an illustrative embodiment, the transverse exhaust hole 106 comprises an aperture that redirects gas traveling through the bore 105 to a direction transverse to the muzzle end of the barrel. In an illustrative embodiment, the fore end 103 comprises a solid material 108 to prevent bullet fragmentation from directly exiting the barrel in a direction coinciding with a point-of-aim direction when a live round is fired.

Figure 3A:
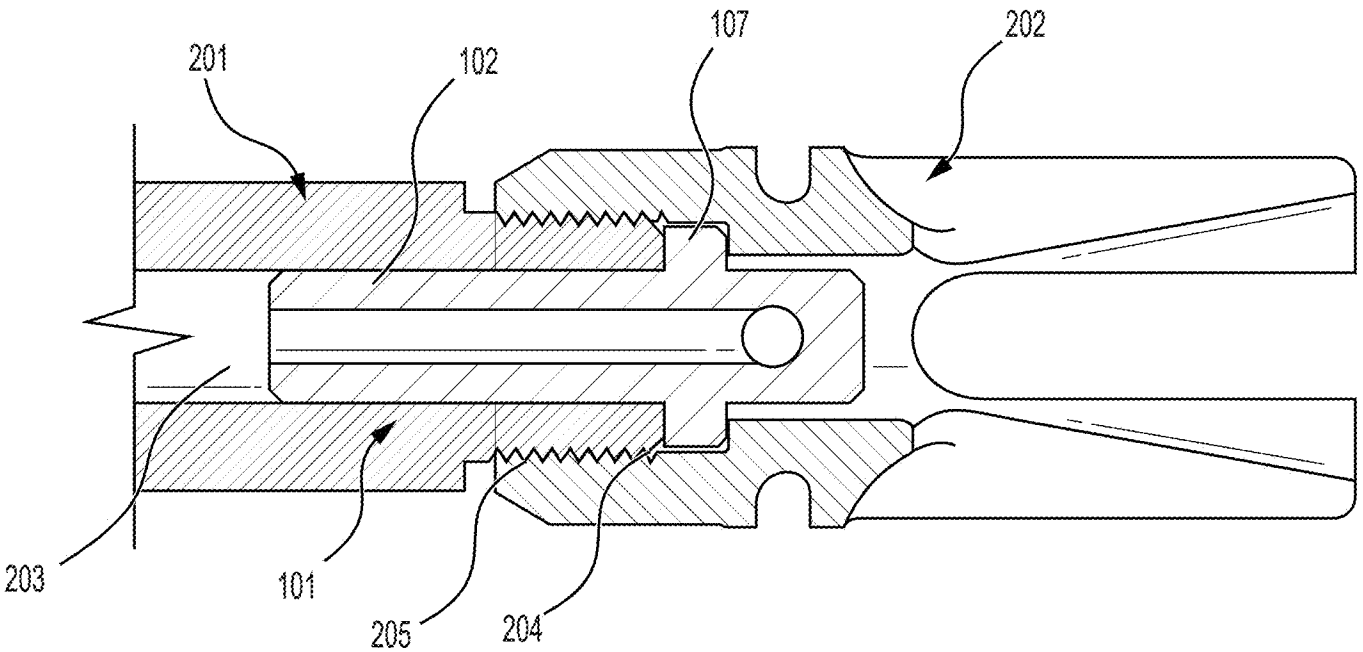
FIG. 3A shows a close-up side sectional view of a firearm barrel, a blank firing adapter, and a muzzle device.
Figure 3B:
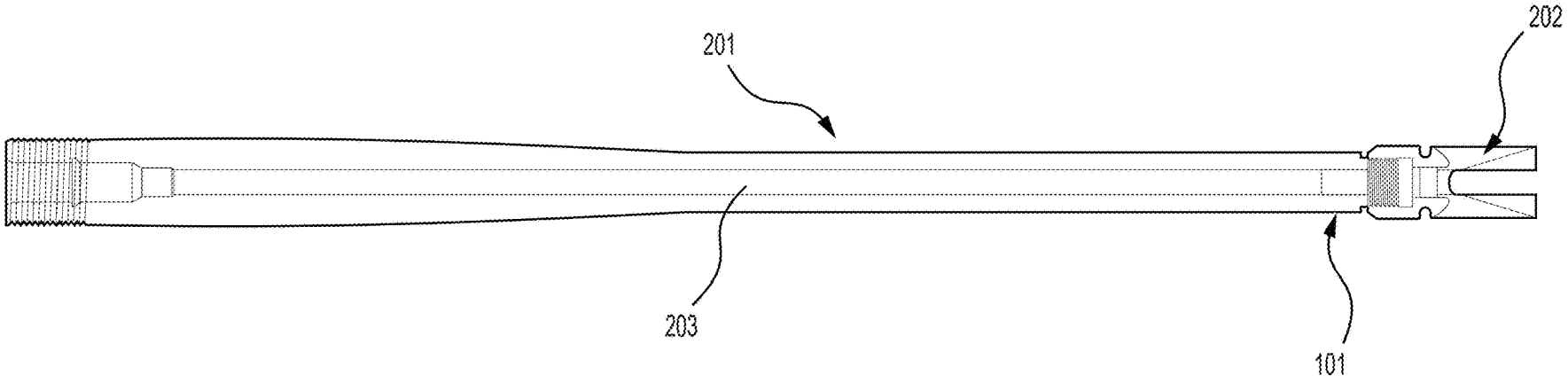
FIG. 3B shows side view of a firearm barrel, a blank firing adapter, and a muzzle device.

FIG. 3A shows a close-up side sectional view of a firearm barrel 201, a blank firing adapter 101, and a muzzle device 202, and FIG. 3B shows a side view of a firearm barrel 201, a blank firing adapter 101, and a muzzle device 202. In an illustrative embodiment, the BFA 101 fits within the barrel bore 203 of a firearm barrel 201. In an illustrative embodiment, the BFA body 102 is smaller than the barrel bore 203 diameter to permit case of installation and removal of the BFA 101 if/when needed for maintenance and cleaning of both the BFA 101 and the barrel bore 203. In an illustrative embodiment, the body 102 is positioned within a muzzle end 204 of the firearm barrel 201 and the flange 107 is positioned exterior to and abutting the muzzle end 204 of the firearm barrel 201.

In an illustrative embodiment, a muzzle device 202 can be attached to the muzzle end 204 of the firearm barrel 201 with the BFA 101 installed. In a non-limiting example, as shown in FIG. 3A, a flash hider muzzle device 202 can be used with the BFA 101 installed. As shown in this embodiment, the BFA 101 is installed within the barrel bore 203 and the muzzle device 202 is threaded onto the external threads 205 at the muzzle end 204 of the firearm barrel 201. The flange 107 is positioned between the muzzle end 204 of the firearm barrel 201 and the flash hider muzzle device 202. In an illustrative embodiment, an advantage of this configuration is that the BFA 101 is secured in place between the muzzle end 204 and the muzzle device 202 by the flange 107. Additionally, the BFA 101 is not exteriorly visible when installed, which can be particularly beneficial in circumstances where it is desirable for a firearm to look authentic (i.e., in a reenactment or in a movie).

In an illustrative embodiment, to install the BFA 101, the existing muzzle device 202 is first removed from the muzzle end 204 of the firearm barrel 201 by unthreading. As can be appreciated, many types of muzzle device, (i.e., flash hiders, compensators, muzzle brakes, thread protectors, and direct attach sound suppressors) are often attached via threads 205. Once removed, the BFA 101 slides into the barrel bore 203, and the muzzle device 202 is then reattached to the firearm barrel 201 by threading the muzzle device 202 onto the threads 205 until the muzzle device 202 clamps, via contact pressure to the flange 107, which in turn makes contact pressure with the muzzle end 204 of the firearm barrel 201.

Figure 4A:
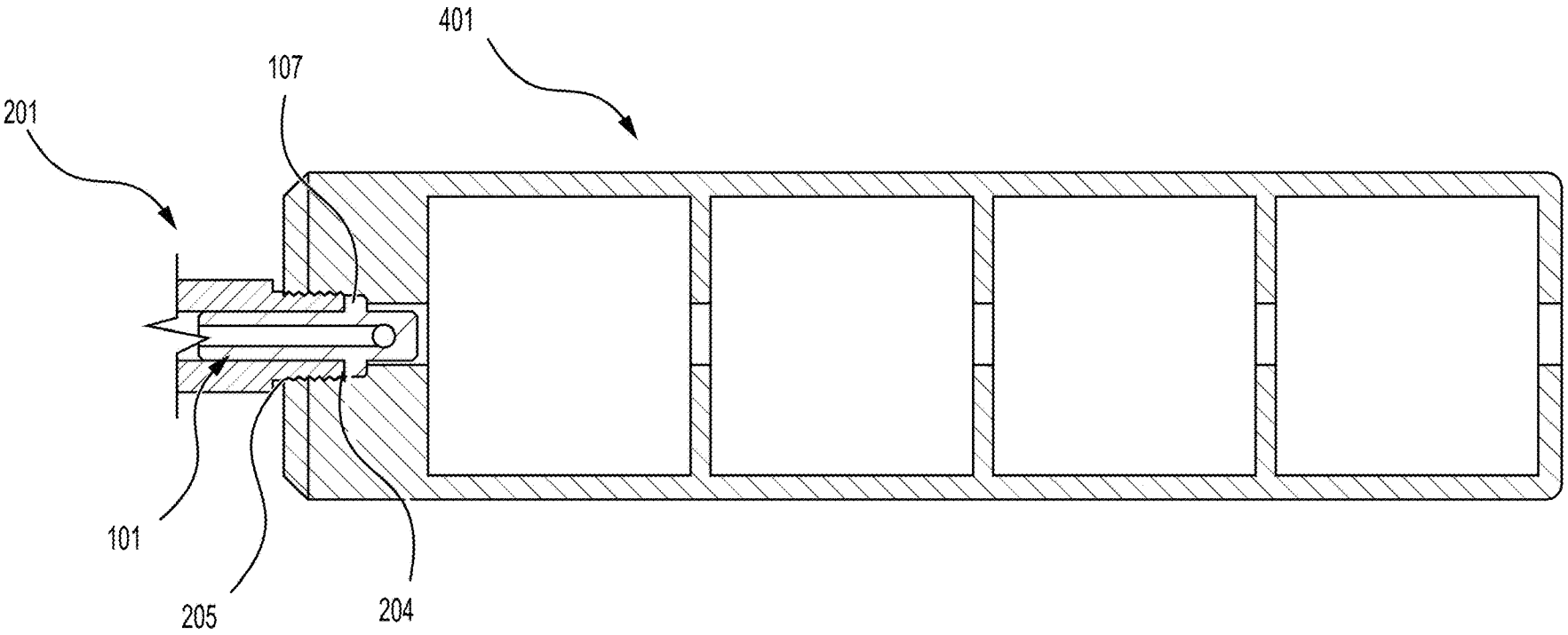
FIG. 4A shows a close-up side sectional view of a firearm barrel, a blank firing adapter, and a direct attach, sound suppressor.
Figure 4B:
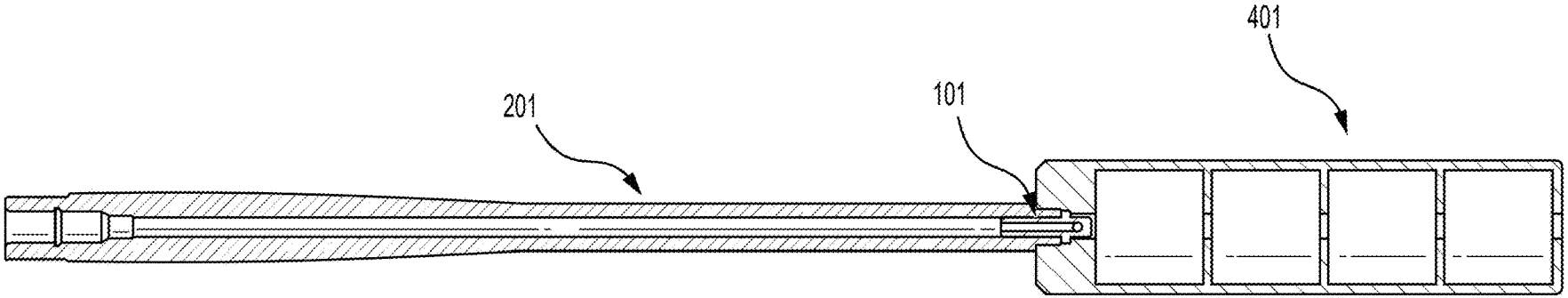
FIG. 4B shows a side sectional view of a firearm barrel, a blank firing adapter, and a direct attach, sound suppressor.

FIG. 4A shows a close-up side sectional view of a firearm barrel 201, a blank firing adapter 101, and a direct attach, sound suppressor 401, and FIG. 4B shows a side sectional view of a firearm barrel 201, a blank firing adapter 101, and a direct attach, sound suppressor 401. In an illustrative embodiment, the BFA 101 can be used with a direct attach, sound suppressor 401 that threads onto the muzzle end 204 of the firearm barrel 201. In an illustrative embodiment, a sound suppressor 401 can be attached to the external threads 205 at the muzzle end 204 of the firearm barrel 201. In an alternate illustrative embodiment, a sound suppressor 401 can be attached via a tool-less or quick-attach manner over a flash hider or compensator with the BFA 101 installed. In such embodiments, the BFA 101 can be used as shown and described in FIGS. 3A-B in combination with the muzzle device, with the sound suppressor 401 attaching by a separate mechanical means to the flash hider.

Figure 5:
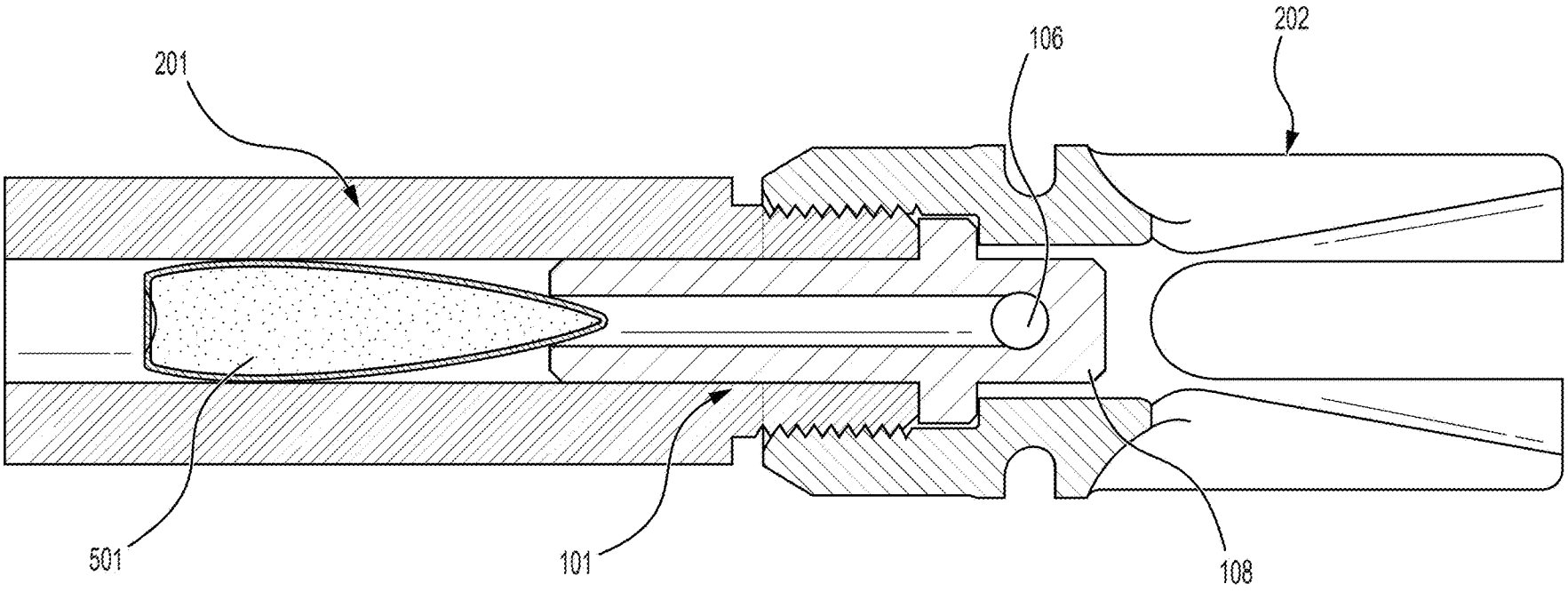
FIG. 5 shows a close-up side sectional view of a firearm barrel, a blank firing adapter, a muzzle device and a bullet making initial contact with the discrete blank firing adapter.
Figure 6:
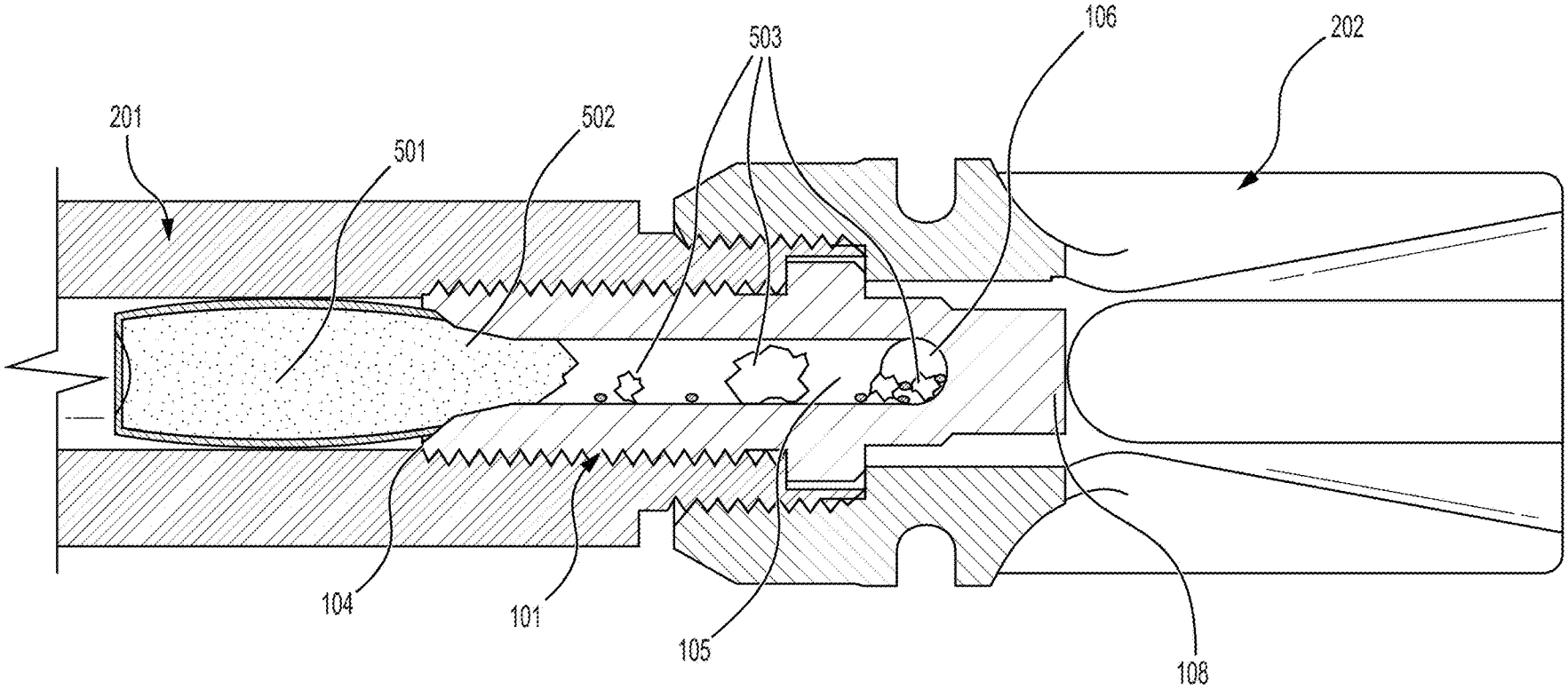
FIG. 6 shows a close-up side sectional view of a bullet making contact with the aft end of a discrete blank firing adapter.

FIGS. 5 and 6 show a close-up side sectional views of a firearm barrel 201, a blank firing adapter 101, a muzzle device 202 and a bullet 501 making initial contact and then being stopped by the discrete blank firing adapter 101. In an illustrative embodiment, the BFA 101 functions as a bullet catch or bullet trap in the event that a live round is inadvertently fired so that the bullet 501 does not travel downrange. The BFA 101 prevents bullet fragmentation from directly exiting the firearm barrel 201 in a direction coinciding with a point-of-aim direction when a live round is fired. In an illustrative embodiment, FIG. 6 shows the bullet 501 making contact with the aft end 104 of the BFA 101. Once fired, a first portion 502 of the bullet 501 is stopped by the aft end 104 of the BFA 101, and bullet fragments 503 may travel down the a bore 105 until it makes contact with the solid material 108. The gas pressure build up within the barrel 201 is released as it travels through the bore 105 and exits the transverse exhaust hole 106.

In an illustrative embodiment, the bore 105 is sized and configured specific to the cartridge caliber, weapon system, and barrel length. In an illustrative embodiment, the transverse exhaust hole 106 comprises an aperture that redirects gas traveling through the bore 105 to a direction normal to the longitudinal axis. This configuration in combination with the solid material 108 at the fore end 103 of the BFA 101 prevents bullet fragmentation from traveling downrange in a direction coincident with the point of aim direction in the event a live round is fired. In an illustrative embodiment, the transverse exhaust hole 106 is less restrictive than the bore 105 so as to allow for the gas to flow out from the barrel without over pressurization. In an illustrative embodiment, the transverse exhaust hole 106 is precisely sized to function as a flow-restrictor to generate sufficient backpressure to enable reliable auto cycling of a weapon system (when used in self-powered, gas-operated weapon system applications). In an illustrative embodiment, the transverse exhaust hole 106 can be configured as a thru-hole. In an illustrative embodiment, the transverse exhaust hole 106 can be configured as a one-sided hole.

Additionally, the BFA 101, bore 105, and transverse exhaust hole 106 are sized and configured to enable sufficient pressure to build in the absence of a bullet when firing blank ammunition. As can be appreciated, the BFA 101 acts as a cork in the barrel 201. With a BFA 101 in place, the generated pressure is redirected through the gas system of the weapon (i.e., the gas tube of an M4/AR-15 style weapon) and is used to facilitate reliable automatic cycling.

Figure 7:
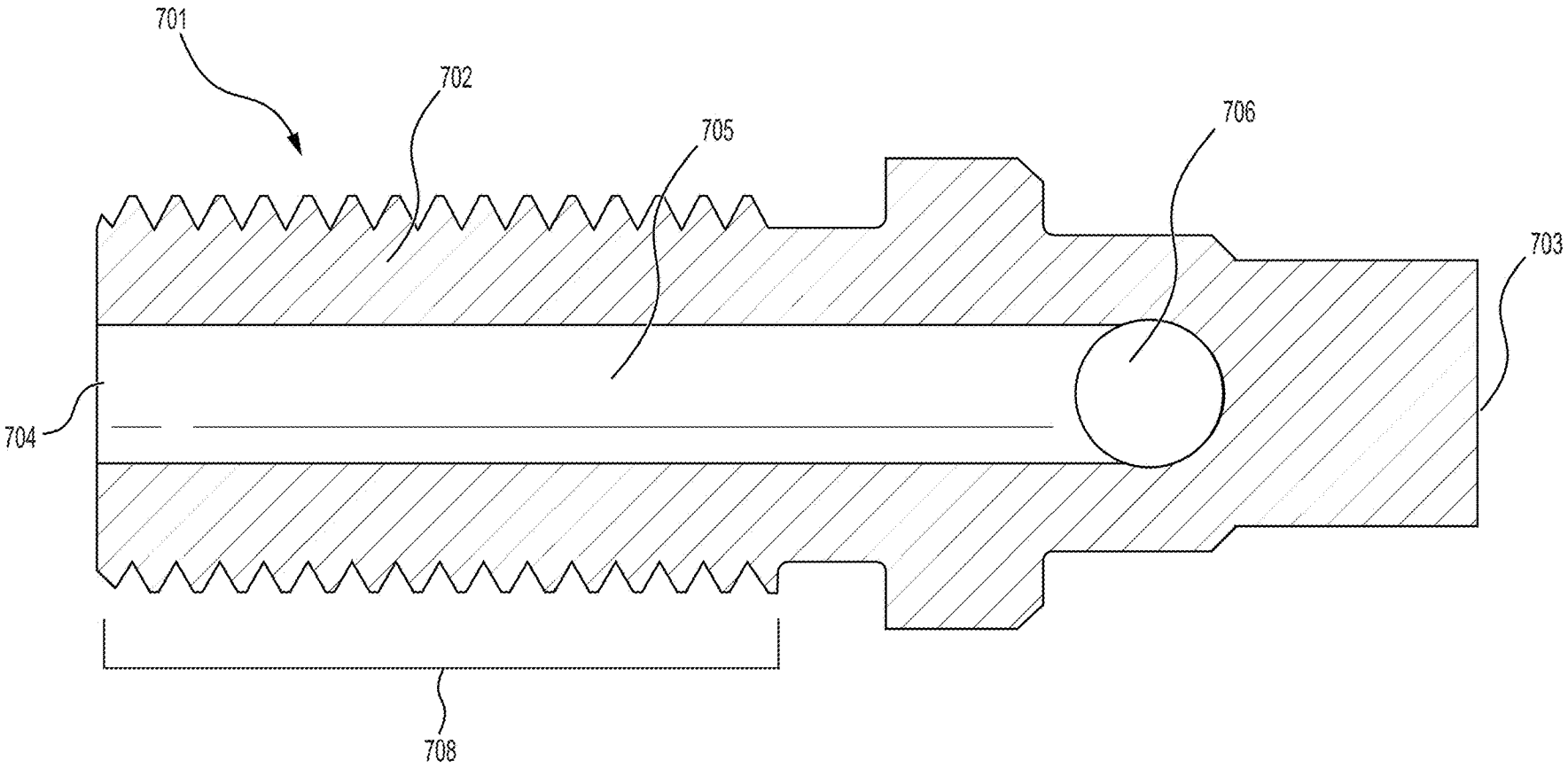
FIG. 7 shows a side sectional view of an alternate embodiment of a discrete blank firing adapter.
Figure 8:
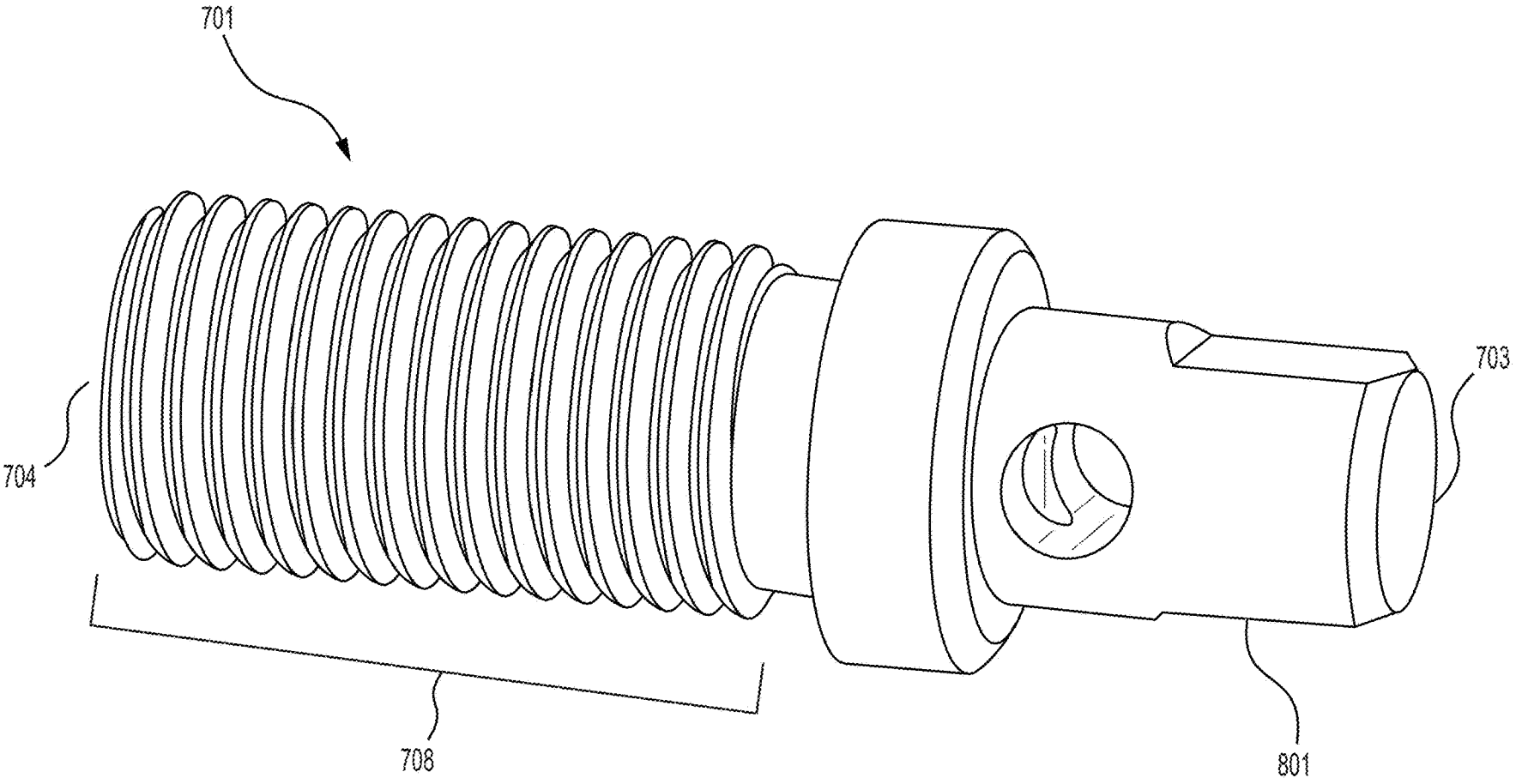
FIG. 8 shows a perspective view of an alternate embodiment of a discrete blank firing adapter.

FIG. 7 shows a side sectional view of an alternate embodiment of a discrete blank firing adapter 701, and FIG. 8 shows a perspective view of an alternate embodiment of a discrete blank firing adapter 701. In an illustrative embodiment, the BFA 701 is designed for use with a firearm barrel having internal threads (shown below) and comprises a body 702, a fore end 703, an aft end 704, a bore 705, a transverse exhaust hole 706, and external threads 708 along a portion of the body 702.

Figure 9:
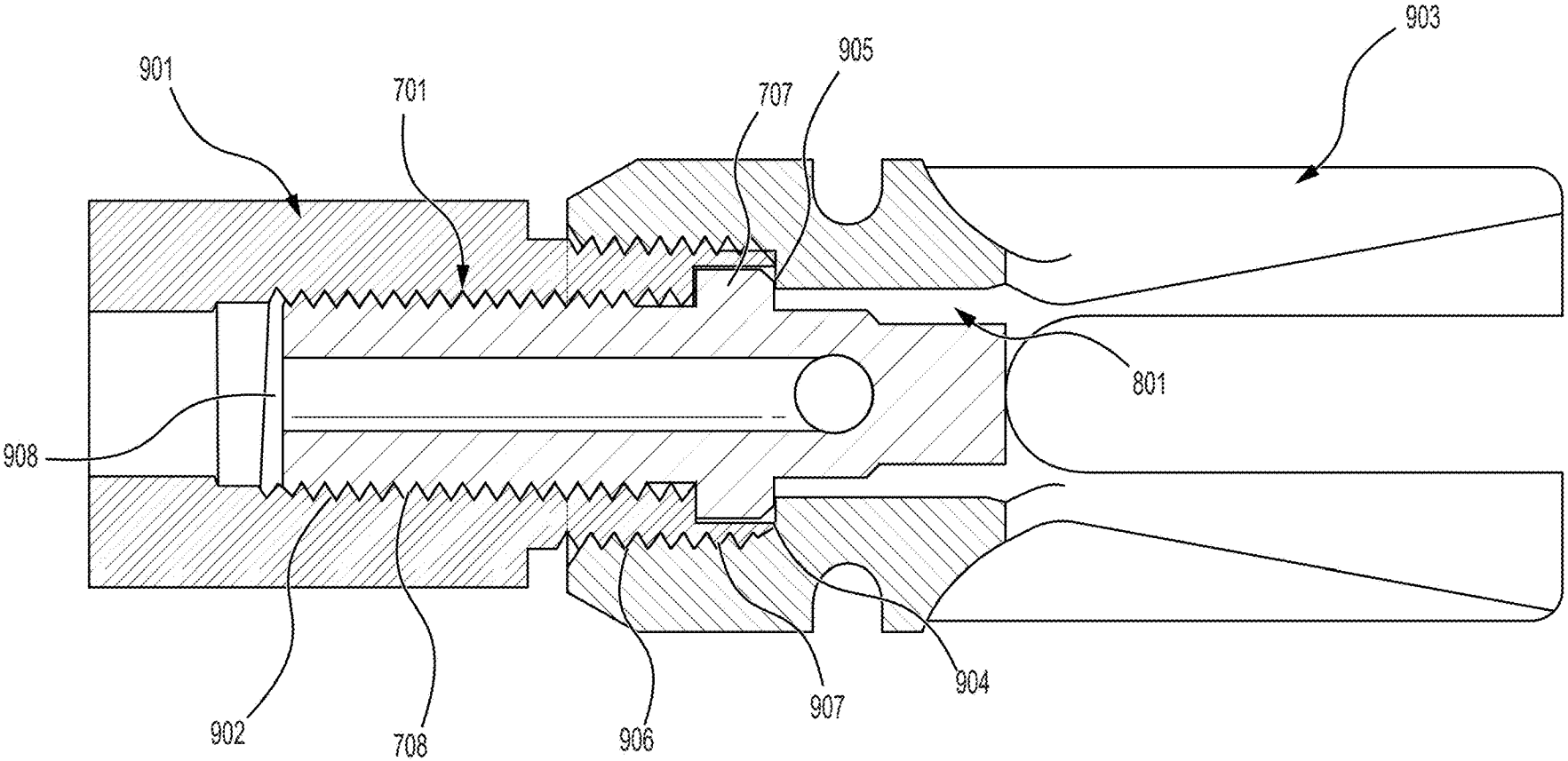
FIG. 9 shows a firearm barrel comprising internal threads, an alternate embodiment of a discrete blank firing adapter comprising external threads, and a muzzle device.

FIG. 9 shows a firearm barrel 901 comprising internal threads 902, an alternate embodiment of a discrete blank firing adapter 701 comprising external threads 708, and a muzzle device 903. In some applications, modification to the barrel 901 and/or muzzle device 903 may be desirable to enhance performance of the BFA 701. In an illustrative embodiment, the addition of internal threads 902 and external threads 708 further increase the structural ability of the BFA 701 to capture a bullet. In an illustrative embodiment, the addition of internal threads 902 and external threads 708 provides redundancy for securing the BFA 701 to the barrel 901. In an illustrative embodiment, the addition of internal threads 902 and external threads 708 replicates the baseline barrel 901 form factor (i.e., overall length) as if the BFA 701 is not even present. In an illustrative embodiment, a threaded connection is added between the BFA 701 and barrel 901 after internal threads 902 are added to a length of the bore 903 at the muzzle end 904 of the barrel 901. As can be appreciated, the threads provide additional structural ability to the system to withstand bullet impact, while also permitting the BFA 701 to be removed for periodic maintenance and cleaning. This provides several advantages over prior art methods of attaching blank firing adapters (i.e., welding), which does not allow for case of BFA removal in order to accommodate cleaning and maintenance and/or optional BFA replacement through the life of the barrel.

In an illustrative embodiment, the BFA 701 can further comprise a flange 707 that fits within the bore 903 at the muzzle end 904 of the barrel 901. In an illustrative embodiment, a counterbore 801 (best viewed in FIG. 9) is added to the muzzle end 904 of the barrel 901 to allow the interfacing shoulder of the BFA 701 to sit flush or below flush with the muzzle crown 905 once installed. The muzzle device 903 encompasses the BFA 701 and is typically attached to the barrel 901 through its own internal threads 906 that mate with external threads 907 on the barrel 901. The existing muzzle device 903 is attached over the BFA 701 and installed fully onto the barrel 901 as it normally would be if a BFA 701 was not present.

The combination of threaded interface between the BFA 701 and barrel 901 and the presence of the flange 707 further enhances the structural ability of the BFA 701 to capture a bullet. The flange 707 functions as a shoulder on the BFA 701, which prevents the BFA 701 from moving towards the muzzle end 904 of the barrel 901 if the threaded interface between BFA 701 and barrel 901 becomes loose. In an illustrative embodiment, the flange 707 makes contact pressure against a barrel feature (i.e., muzzle crown 905) to prevent movement. As can be appreciated, this non-limiting embodiment affords redundancy in the securing and attaching of the BFA 701 to the barrel 901.

In an illustrative embodiment, the BFA disclosed herein can be utilized in combination with other blank firing devices, such as dedicated blank firing barrels or chambers. In a non-limiting embodiment, the BFA disclosed can be utilized in combination with a Pressure discriminating cartridge chamber as disclosed in U.S. Pat. No. 11,796,268 B2. In an illustrative embodiment, the BFA and Pressure discriminating cartridge chamber permit normal firing and function with blank training ammunition while preventing any and all bullets and fragments from leaving the barrel of a firearm.

Although the invention has been described in detail with reference to certain preferred embodiments, variations and modifications exist within the spirit and scope of the invention as described and defined in the following claims.

The invention claimed is:

1. A blank firing adapter for and a firearm barrel;

said firearm barrel comprising a muzzle end, a muzzle crown, a bore, and a counterbore;

said blank firing adapter comprising:

a body, a fore end, an aft end, a bore, a transverse exhaust hole, and a flange;

wherein said body is positioned within said muzzle end of said firearm barrel;

wherein said counterbore permits said flange to fit within said bore of said firearm barrel and flush with said muzzle crown;

wherein said bore extends from said aft end through said body and terminates at said transverse exhaust hole;

wherein said transverse exhaust hole comprises an aperture that redirects gas traveling through said bore to a direction transverse to said muzzle end of said barrel; and wherein said fore end comprises a solid material to prevent bullet fragmentation from directly exiting said barrel in a direction coinciding with a point-of-aim direction when a live round is fired;

wherein said flange within said counterbore enhances the structural ability of said blank firing adapter to capture a bullet.

2. The device of claim 1, wherein said body is smaller than a firearm barrel bore diameter to permit ease of installation and removal of said blank firing adapter.

3. The device of claim 1, wherein said body is positioned within a muzzle end of said firearm barrel and said flange is positioned exterior to and abutting said muzzle end of said firearm barrel.

4. The device of claim 1, wherein a muzzle device can be attached to said muzzle end of said firearm barrel with said BFA installed therein.

5. The device of claim 1, wherein said flange is positioned between said muzzle end of said firearm barrel and said muzzle device.

6. The device of claim 1, wherein said blank firing adapter can be used with a direct attach muzzle device that threads onto said muzzle end of said firearm barrel.

7. The device of claim 1, wherein said blank firing adapter catches or traps a bullet when fired so that said bullet does not travel downrange.

8. The device of claim 1, wherein said blank firing adapter prevents bullet fragmentation from directly exiting said firearm barrel in a direction coinciding with a point-of-aim direction when a bullet is fired.

9. The device of claim 1, wherein pressure build up within said barrel travels through said bore and exits said transverse exhaust hole.

10. The device of claim 1, wherein said bore is sized and configured specific to said cartridge caliber, weapon system, and barrel length.

11. The device of claim 1, wherein said transverse exhaust hole is less restrictive than said bore to allow gas to flow out from said barrel without over pressurization.

12. The device of claim 1, wherein said transverse exhaust hole is sized to provide flow-restriction to generate sufficient backpressure and enable auto cycling of a weapon system.

13. The device of claim 1, wherein said bore and said transverse exhaust hole are sized and configured to enable sufficient pressure to build in absence of a bullet when firing blank ammunition.

14. A blank firing adapter and a firearm barrel;

said firearm barrel comprising a muzzle end, a muzzle crown, a bore, a counterbore, internal threads and external threads at a muzzle end;

said blank firing adapter comprising:

a body, a fore end, an aft end, a bore, a transverse exhaust hole, and external threads along a portion of said body, and a flange;

wherein said body is positioned within said muzzle end of said firearm barrel and said external threads of said body are threadably attached to said internal threads of said firearm barrel;

wherein said counterbore permits said flange to fit within said bore of said firearm barrel and flush with said muzzle crown;

wherein said bore extends from said aft end through said body and terminates at said transverse exhaust hole;

wherein said transverse exhaust hole comprises an aperture that redirects gas traveling through said bore to a direction transverse to said muzzle end of said barrel; and wherein said fore end comprises a solid material to prevent bullet fragmentation from directly exiting said barrel in a direction coinciding with a point-of-aim direction when a live round is fired;

wherein said flange within said counterbore enhances the structural ability of said blank firing adapter to capture a bullet.

15. The device of claim 14, wherein said blank firing adapter further comprises a flange that fits within said bore at said muzzle end of said barrel.

16. The device of claim 14, wherein said muzzle device comprises internal threads that attach to said external threads on said firearm barrel, and wherein said blank firing adapter fits within said bore at said muzzle end of said barrel.

17. The device of claim 14, wherein said body is smaller than a firearm barrel bore diameter to permit ease of installation and removal of said blank firing adapter.

18. The device of claim 14, wherein a muzzle device can be attached to said muzzle end of said firearm barrel with said BFA installed therein.

19. The device of claim 14, wherein said blank firing adapter catches or traps a bullet when fired so that said bullet does not travel downrange.

20. The device of claim 14, wherein said blank firing adapter prevents bullet fragmentation from directly exiting said firearm barrel in a direction coinciding with a point-of-aim direction when a bullet is fired.

21. The device of claim 14, wherein pressure build up within said barrel travels through said bore and exits said transverse exhaust hole.

22. The device of claim 14, wherein said bore is sized and configured specific to said cartridge caliber, weapon system, and barrel length.

23. The device of claim 14, wherein said transverse exhaust hole is less restrictive than said bore to allow gas to flow out from said barrel without over pressurization.

24. The device of claim 14, wherein said transverse exhaust hole is sized to provide flow-restriction to generate sufficient backpressure and enable auto cycling of a weapon system.

25. The device of claim 14, wherein said bore and said transverse exhaust hole are sized and configured to enable sufficient pressure to build in absence of a bullet when firing blank ammunition.

26. The device of claim 14, wherein said blank firing adapter can be used with a direct attach muzzle device that threads onto said muzzle end of said firearm barrel.

27. The device of claim 14, wherein said flange is positioned between said muzzle end of said firearm barrel and said muzzle device.

* * * * *